US006210021B1

(12) United States Patent
Helbig et al.

(10) Patent No.: US 6,210,021 B1
(45) Date of Patent: Apr. 3, 2001

(54) ELECTRIC LAMP WITH ROTATABLE BASE INCLUDING COMPRESSED CONTACTS

(75) Inventors: Peter Helbig, Sontheim; Gerhard Behr, Altheim, both of (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/378,862

(22) Filed: Aug. 23, 1999

(30) Foreign Application Priority Data

Sep. 23, 1998 (DE) ..... 198 43 506

(51) Int. Cl.[7] ..... H01R 33/00

(52) U.S. Cl. ..... 362/226; 362/368; 313/318.01; 439/56

(58) Field of Search ..... 362/226, 368; 313/318.01, 318.12; 439/699.2, 56

(56) References Cited

U.S. PATENT DOCUMENTS

| | | | | |
|---|---|---|---|---|
| 4,473,770 | * | 9/1984 | Baba et al. | 313/318 |
| 4,704,090 | | 11/1987 | Marshall | 439/56 |
| 5,008,588 | | 4/1991 | Nakahara | 313/318 |
| 5,313,135 | * | 5/1994 | Fletcher | 313/318 |
| 5,320,539 | * | 6/1994 | Haskins | 439/56 |
| 5,513,082 | | 4/1996 | Asano | 362/226 |
| 5,818,154 | * | 10/1998 | Helbig et al. | 313/318.01 |
| 5,951,318 | * | 9/1999 | Harada | 439/356 |
| 5,957,569 | * | 9/1999 | Helbig et al. | 362/263 |
| 6,005,336 | * | 12/1999 | Helbig et al. | 313/318.01 |
| 6,095,866 | * | 8/2000 | Helbig et al. | 439/619 |

FOREIGN PATENT DOCUMENTS

| | | |
|---|---|---|
| 296 16 116 | 1/1997 | (DE) . |
| 296 16 116 U | 1/1997 | (DE) . |
| 0 367 343 | 5/1990 | (EP) . |
| 0 684 669 | 11/1995 | (EP) . |

* cited by examiner

*Primary Examiner*—Alan Cariaso
*Assistant Examiner*—Ronald E. DelGizzi
(74) *Attorney, Agent, or Firm*—William E. Meyer

(57) ABSTRACT

The invention relates to an electric lamp, the cap (3) of which has at least two resilient tabs (8), which are each provided with a latching lug **(8*a*), and an attachment ring (6), which is mounted so that it can rotate about its ring axis, the tabs (8) bearing against the inside of the attachment ring (6) with a clamping fit, and the inside having wall areas which are at different distances from the ring axis. By rotation of the attachment ring (6), pressure is exerted on the tabs (8) and the latching connection of the latching lugs (8*a*)** in the lamp holder is released.

8 Claims, 3 Drawing Sheets

ELECTRIC LAMP WITH ROTATABLE BASE INCLUDING COMPRESSED CONTACTS

The invention relates to an electric lamp and particularly to a motor vehicle lamp, and more particularly to a motor vehicle lamp with a twist mount base.

1. BACKGROUND ART

An electric lamp with twist mounts bases are known, for example, in German Utility Model 296 16 116. The lamp described in the abovementioned Utility Model is an incandescent lamp which is intended to be used in a motor vehicle for generating the brake light, tail light or indicator light functions. In this lamp, depending on the use desired, the lamp cap is designed either as a plug connector or is equipped with sliding contacts for mounting on printed circuit boards.

2. SUMMARY OF THE INVENTION

The object of the invention is to provide an electric lamp which has an improved lamp cap making it easier to fit the lamp in the lamp holder.

The electric lamp according to the invention has a luminous means which is enclosed by a lamp bulb, a lamp cap, in which the lamp bulb is secured, and electrical cap contacts, as well as supply conductors for supplying power to the luminous means. According to the invention, the cap has at least two tabs which are of resilient design and are each provided with a latching lug, and an annular disc which is mounted so that it can rotate about the ring axis, the annular disc possessing an inner wall which faces towards the ring axis and has wall areas which are at different distances from the ring axis, and the at least two tabs bearing against the inner wall of the disc. By rotation of the annular disc, the inner wall of the disc exerts a greater or lesser pressure on the at least two tabs, so that these tabs, depending on the position of the disc, are bent further or less far towards the ring axis. In this way, the latching connection between the latching lugs which are connected to the at least two tabs and the lamp holder is either released or brought about depending on the angle of rotation of the annular disc. In this way, the design according to the invention makes it easy to fit the lamp in the lamp holder.

Advantageously, the annular disc has a plurality of slots which are in the form of ring segments, are arranged parallel to the circumference of the annular disc and in each of which one guide web, which is formed integrally on the cap, engages. The guide webs and the slots define stops for the rotary movement of the annular disc and improve the anchoring of the disc in the cap. Advantageously, the latching lugs each have an underside which is arranged parallel to the plane of the annular disc, in a common plane. In addition, the cap advantageously has at least three spread-open spring elements which are designed as counter-bearings to the latching lugs. The abovementioned features allow the lamp according to the invention to be mounted on a printed circuit board or on a mounting plate, the undersides of the latching lugs bearing against the top side of the printed circuit board or mounting plate, and the spread-open spring elements being supported on the underside of the printed circuit board or mounting plate. Moreover, the cap of the electric lamp according to the invention advantageously has a cutout for accommodating a pin-like holder part or plug-connector part. As a result, the lamp according to the invention is also suitable for mounting on a lamp holder which is designed as a plug connector. The electrical cap contacts are advantageously designed as contact tabs, the contact tabs particularly advantageously each having an end which is spread open from the cap and also delimiting part of the cutout for accommodating the plug. The abovementioned features of the cap contacts ensure an optimum electrical connection between the cap contacts and the holder contacts for the various mounting options of the lamp according to the invention.

BEST MODE FOR CARRYING OUT THE INVENTION

Figure 1:
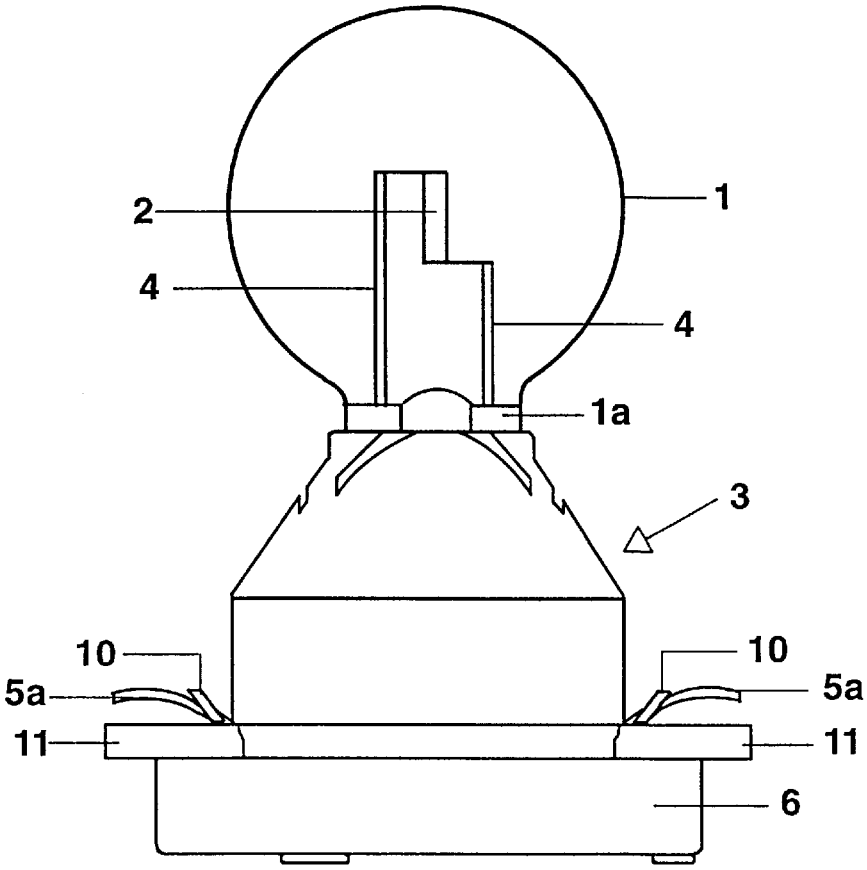
FIG. 1 shows a side view of an electric lamp according to the preferred exemplary embodiment of the invention
Figure 2:
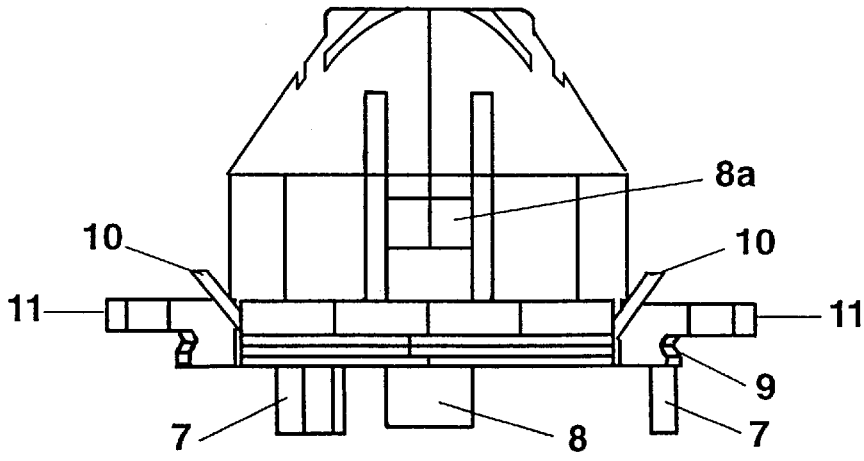
FIG. 2 shows a side view of the lamp cap of the lamp shown in FIG. 1, without the attachment ring
Figure 3:
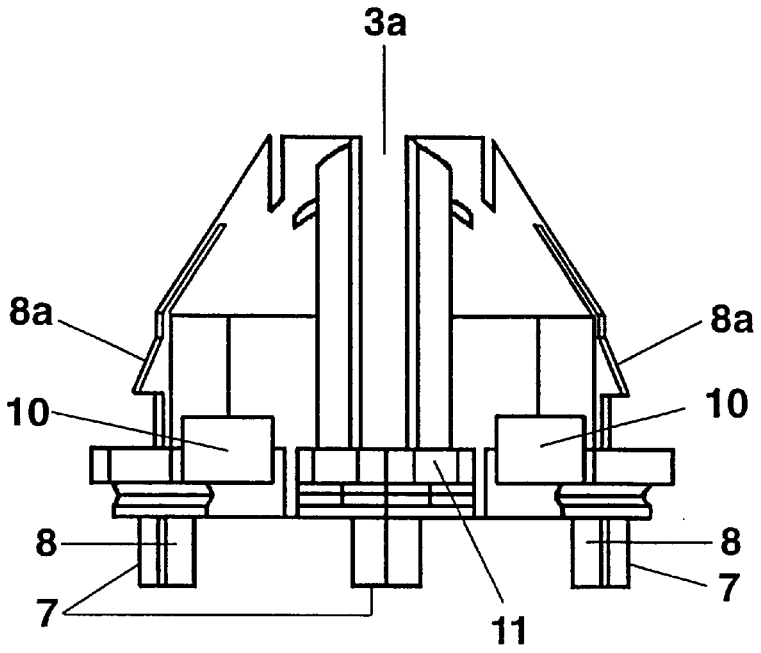
FIG. 3 shows a side view of the lamp cap in accordance with FIG. 2, in a side view which has been rotated through 90° with respect to that shown in FIG. 2, without the attachment ring
Figure 4:
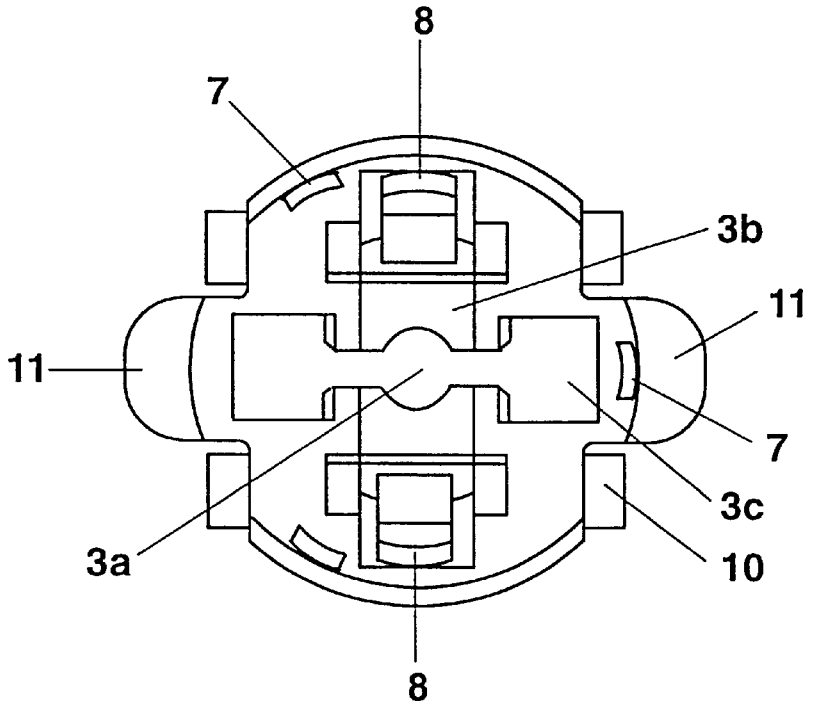
FIG. 4 shows the underside of the lamp cap according to the preferred exemplary embodiment, without the attachment ring
Figure 5:
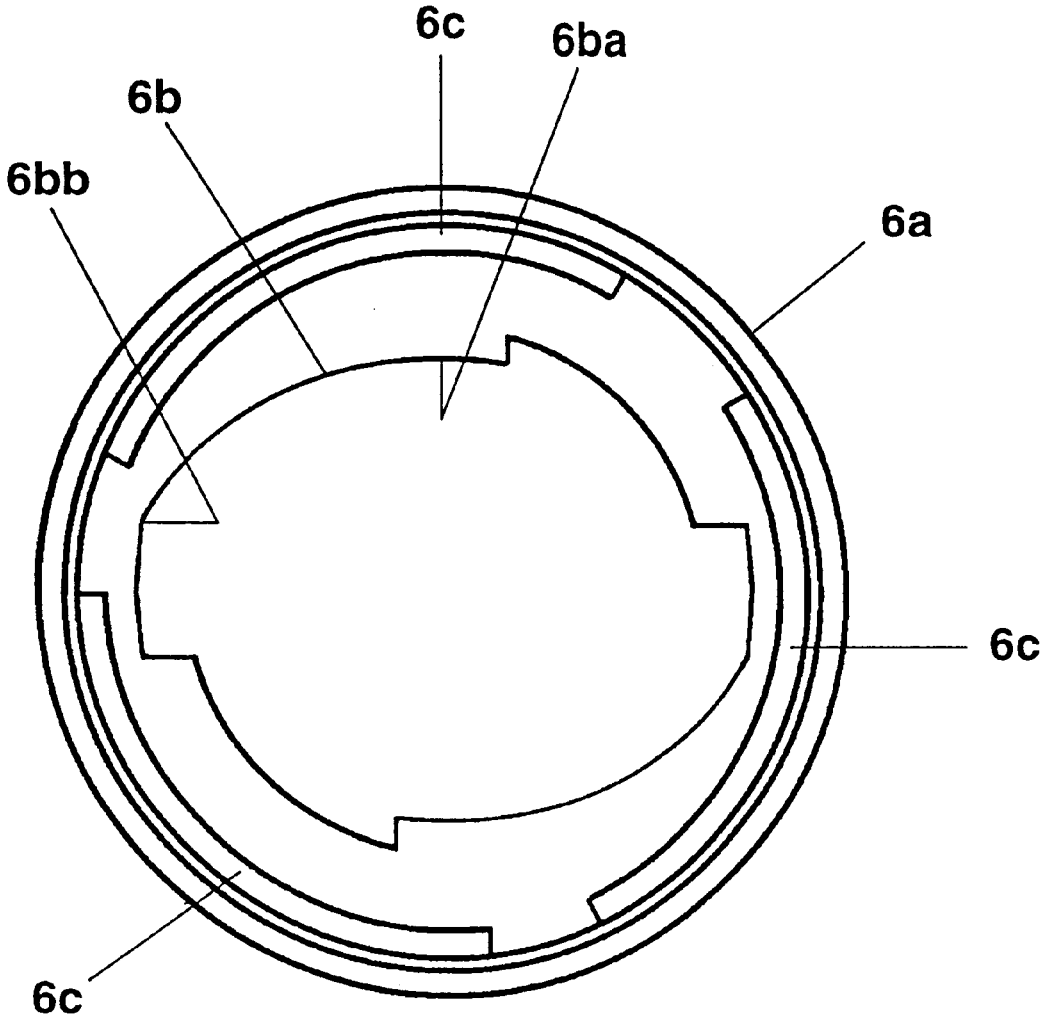
FIG. 5 shows a plan view of the attachment ring of the lamp illustrated in FIG. 1

FIG. 1 shows an electric lamp according to the preferred exemplary embodiment of the invention. This lamp has a glass lamp bulb 1 with an end 1*a* which is sealed in a gas tight manner and from which two supply conductors 4 project, which conductors are connected in an electrically conductive manner to an incandescent filament 2 which is arranged inside the lamp bulb 1. The sealed end 1*a* of the lamp bulb 1 is fixed in a cap 3 made from plastic. The top part, facing towards the lamp bulb 1, of the cap 3 has a cutout 3*a* which fits accurately and in which the end 1*a* of the lamp bulb 1 is fixed in a form-fitting manner. On its underside, the cap 3 has a cutout 3*b* for accommodating a pin-like holder part or plug-connector part. A chamber 3*c* is arranged on both sides of the cutout 3*b*, each chamber serving to accommodate a plug-connector contact. An electrical cap contact, which is designed as a contact tab, is arranged in each of the chambers 3*c*. The contact tabs each form an outside wall of a chamber 3*c* and, as a result, form the electrical contact between the plug-connector contacts (not shown), which are arranged in the chambers 3*c*, and the supply conductors 4. The two contact tabs each have an end 5*a* which is spread open from the cap 3. In the inside of the cap, the other end of each of the contact tabs is welded to one of the supply conductors 4. The spread-open ends 5*a* of the contact tabs form the electrical connection to the conductor tracks if the lamp is mounted on a printed circuit board.

The bottom part of the cap 3 is provided with an annular, rotatably mounted disc 6. To attach the annular disc 6 to the cap 3, the disc 6 and the bottom part of the cap 3 respectively have a continuous annular groove 9 and a collar which is matched to the groove. The annular disc 6, which is referred to below as the attachment ring 6, is mounted so that it can rotate about a ring axis arranged perpendicular to the plane of the disc. The ring axis coincides with the lamp axis. The attachment ring 6 has an outside wall 6*a* which is remote from the ring axis and an inside wall 6*b* which faces towards the ring axis. The inner wall 6*b* has wall areas 6*ba*, 6*bb* which are at different distances from the ring axis. The attachment ring 6 is provided with three slots 6*c*, which are in the form of ring segments, are arranged parallel to the circumference of the ring and in each of which one guide web 7, which is formed integrally on the underside of the cap 3, engages. Furthermore, two mutually opposite tabs 8 are formed integrally on the cap 3, which tabs are of resilient design and on the outside bear against the inner wall 6*b* of the attachment ring 6 with a clamping action. The outsides of the two tabs 8 are each provided with an integrally formed latching lug 8*a*. The bottom edges of the latching lugs 8*a* lie in a common plane which runs parallel to the plane of the attachment ring 6. The cap 3 is furthermore equipped with four spread-open spring elements 10 which serve as counter-bearings to the latching lugs 8*a* when the lamp is mounted on a printed circuit board. Beneath each of the two spread-open contact tongue ends 5*a*, the cap 3 has an integrally formed extensive piece 11, which is used to stabilize the corresponding contact tongue end 5*a*. The bottom edges of the tabs 8 and of the guide webs 7 lie in a common plane which is perpendicular to the lamp axis.

The lamp according to the preferred exemplary embodiment described above is a brake light lamp or indicator light lamp for a motor vehicle. This lamp can be mounted in various different ways and can therefore be employed universally in motor vehicles. It can be installed both as an indicator lamp in a front headlight of the motor vehicle and as an indicator lamp or brake light lamp in the rear lights of the motor vehicle. Three different mounting options are explained briefly below.

Mounting on a printed circuit board

To be mounted on a printed circuit board in a light fitted with a reflector (e.g. in motor vehicle rear lights), the lamp is pre-mounted by plugging the lamp into the reflector. During this operation, the latching lugs 8*a* latch into the light reflector. The bottom edges of the latching lugs 8*a* serve as a reference plane for adjusting the lamp in the reflector. After mounting, the printed circuit board is arranged between the bottom edges of the two latching lugs 8*a* and the four spread-open spring elements 10. The spread-open ends 5*a* of the two contact tabs form the electrical contact with the conductor tracks on the printed circuit board. To remove the lamp, the attachment ring 6 is rotated sufficiently far for the latching connection of the latching lugs 8*a* in the reflector to be released.

Mounting in a headlight on a plug

To mount the lamp on a plug in the rear reflector opening of a motor vehicle headlight, the lamp is firstly latched in the rear reflector opening by means of the latching lugs 8*a*. In this case, the edge of the rear reflector opening is arranged between the bottom edge of the latching lugs 8*a* and the four spread-open spring elements 10. The plug is fitted onto the lamp cap 3. In the process, a pin-like plug-connector part engages into the cutout 3*b* in the lamp cap. After mounting, the two plug-connector contacts are arranged in the chambers 3*c* of the cap and are in electrical contact with the contact tabs of the lamp. The plug connector has a surrounding sealing ring which bears against the outer wall of the reflector and seals the rear reflector opening against the penetration of atmospheric moisture. To change the lamp, firstly the plug connector is pulled off, and then the attachment ring 6 is rotated sufficiently far for the latching connection of the latching lugs 8*a* in the reflector to be released.

Mounting on a mounting plate

To mount the lamp on a mounting plate with pin-like holder parts, the lamp is fitted onto the mounting plate. In the process, a pin-like holder part engages into the cap cutout 3*b*, and the resilient holder contacts of the mounting plate are introduced into the chambers 3*c*, so that they produce electrical contact with the contact tabs of the lamp. Then, the mounting plate, together with the lamp or lamps which have been attached, is secured in the light reflector. In this type of mounting, the latching lugs 8*a* and the attachment ring 6 have no role.

What is claimed is:

1. An electric lamp, comprising a lamp bulb (1), at least one luminous means (2) which is arranged inside the lamp bulb (1), a cap (3), in which the lamp bulb (1) is fixed and which is provided with electrical cap contacts (5*a*), at least two supply conductors (4) which are guided out of the lamp bulb (1) and are connected in an electrically conductive manner to the cap contacts (5*a*), characterized in that the cap (3) has at least two tabs (8) which are of resilient design and are each provided with a latching lug (8*a*), the cap (3) has an annular disc (6) which is mounted so that the disc can rotate with respect to the two tabs (8) about a ring axis arranged perpendicular to the plane of the disc, the annular disc (6) possessing an inner wall (6*b*) which faces towards the ring axis and has wall areas (6*ba*, 6*bb*) at different distances from the ring axis, and the tabs (8) bear against the inner wall (6*b*) of the annular disc (6).

2. The electric lamp according to claim 1, characterized in that the latching lugs (8*a*) each have an underside which runs parallel to the plane of the disc, the undersides of the latching lugs (8*a*) being arranged in a ccommon plane.

3. The electric lamp according to claim 1, characterized in that the cap (3) has at least three spread-open spring elements (10) which are designed as counter-bearings to the latching lugs (8*a*).

4. The electric lamp according to claim 1, characterized in that the annular disc (6) has a plurality of slots (6*c*) which are in the form of ring segments, the slots (6*c*) are arranged parallel to the circumference of the annular disc and in each of the slots 6*c*, is engaged respectively a guide web (7), integrally formed on the cap (3).

5. The electric lamp according to claim 1, characterized in that the cap (3) has a cutout (3*b*) for accommodating a pin-like holder part or plug-connector part.

6. The electric lamp according to claim 1, characterized in that the cap contacts are designed as contact tabs.

7. The electric lamp according to claim 6, characterized in that the contact tabs each have an end (5*a*) which is spread open from the cap.

8. An electric lamp according to claim 5, characterized in that the cutout (3*b*) is partly delimited by contact tabs.

* * * * *